US010389017B2

(12) United States Patent
Cho et al.

(10) Patent No.: US 10,389,017 B2
(45) Date of Patent: Aug. 20, 2019

(54) ROOF ANTENNA FOR VEHICLES AND WATERTIGHT STRUCTURE FOR ROOF ANTENNA FOR VEHICLES

(71) Applicants: HYUNDAI MOTOR COMPANY, Seoul (KR); KIA MOTORS CORPORATION, Seoul (KR)

(72) Inventors: Yong Sik Cho, Hwaseong-si (KR); Hee Kuk Ryeu, Hwaseong-si (KR); Soon Bag Joung, Busan (KR); Tae Byung Park, Anyang-si (KR); Gi Cho Kang, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/380,115

(22) Filed: Dec. 15, 2016

(65) Prior Publication Data

US 2017/0365917 A1 Dec. 21, 2017

(30) Foreign Application Priority Data

Jun. 17, 2016 (KR) ..... 10-2016-0075719

(51) Int. Cl.

| | |
|---|---|
| ***H01Q 1/12*** | (2006.01) |
| ***H01Q 1/32*** | (2006.01) |
| ***H01Q 1/42*** | (2006.01) |

(52) U.S. Cl.

CPC ..... *H01Q 1/3275* (2013.01); *H01Q 1/42* (2013.01); *H01Q 1/427* (2013.01); *H01Q 1/1214* (2013.01); *H01Q 1/422* (2013.01)

(58) Field of Classification Search

CPC .... H01Q 1/3275; H01Q 1/1214; H01Q 1/427; H01Q 1/424; H01Q 1/422

See application file for complete search history.

(56) References Cited

U.S. PATENT DOCUMENTS 5,585,809 A * 12/1996 Yajima ..... H01Q 1/088 248/206.5

6,690,335 B2 2/2004 Onishi et al.

(Continued)

FOREIGN PATENT DOCUMENTS

JP 2009-284366 A 12/2009

JP 2016-036102 A 3/2016

(Continued)

OTHER PUBLICATIONS

Machine Translation of KR 101342027.*

*Primary Examiner* — Ricardo I Magallanes

(74) *Attorney, Agent, or Firm* — Morgan, Lewis & Bockius LLP

(57) ABSTRACT

A roof antenna attached to a vehicle includes an adhesive applied to a designated thickness, an upper case formed in a streamlined dome shape having an opened lower surface, and a lower case combined with the upper case, the lower case shielding the opened lower surface of the upper case and provided with an antenna module mounted on an upper surface of the lower case, wherein the lower case is combined with a roof of the vehicle, one surface of a pad formed of the adhesive is applied to a lower surface of the lower case, and another surface of the pad formed of the adhesive is attached to the roof.

4 Claims, 12 Drawing Sheets

(56) References Cited

U.S. PATENT DOCUMENTS

| | | | | |
|---|---|---|---|---|
| 2002/0158809 | A1* | 10/2002 | Onishi | H01Q 1/00 343/872 |
| 2008/0100521 | A1* | 5/2008 | Herbert | H01Q 1/1214 343/713 |
| 2014/0159964 | A1* | 6/2014 | Kaneko | H01Q 1/3275 343/702 |
| 2014/0292593 | A1* | 10/2014 | Thiam | H01Q 1/3275 343/713 |
| 2015/0178613 | A1* | 6/2015 | Hoelzl | B32B 37/12 235/488 |

FOREIGN PATENT DOCUMENTS

| | | | |
|---|---|---|---|
| KR | 20-2008-0003703 | U | 9/2008 |
| KR | 20-2012-0001567 | U | 3/2012 |
| KR | 10-1342027 | B1 | 12/2013 |
| KR | 101342027 | B1 * | 12/2013 |
| KR | 10-1409624 | B1 | 6/2014 |
| KR | 10-1564327 | B1 | 11/2015 |

* cited by examiner (a)

(b)

(a)

(b)

(c)

(d)

| Division | Experimental Pressure Value (bar) | | | | | | | | | | | | | | |
|---|---|---|---|---|---|---|---|---|---|---|---|---|---|---|---|
| | 0.2 | 0.4 | 0.6 | 0.8 | 1.0 | 1.2 | 1.4 | 1.6 | 1.8 | 2.0 | 2.2 | 2.4 | 2.6 | 2.8 | 3.0 |
| Conventional Roof Ant. | Air Discharge | | | | | | | | | | | | | | |
| Roof Ant. of Present Invention | | | | | | | | | | | | | Air Discharge | | |

| 180BAR | |
|---|---|
| 10cm | 20cm |
| OK | OK |
| OK | OK |

ROOF ANTENNA FOR VEHICLES AND WATERTIGHT STRUCTURE FOR ROOF ANTENNA FOR VEHICLES

This application claims the benefit of priority to Korean Patent Application No. 10-2016-0075719, filed on Jun. 17, 2016 with the Korean Intellectual Property Office, which is hereby incorporated by reference as if fully set forth herein.

TECHNICAL FIELD

The present disclosure relates to vehicle technology, and more particularly, to a roof antenna for vehicles and a watertight structure for the roof antenna or vehicles.

BACKGROUND

In general, an antenna for vehicles to receive or transmit radio waves is installed at the inside or outside of a vehicle. FIG. 1 illustrates one exemplary antenna installed at the outside of a vehicle. A roof antenna 60 for vehicles may be combined with a vehicle roof 50. The roof antenna 60 may be referred to as a shark fin antenna due to a design thereof.

The roof antenna 60 is generally configured such that an upper case 65 and a lower case 63 are fastened to each other and an antenna is disposed in the upper case 65 and the lower case 63.

FIGS. 2(*a*) to 3 are views illustrating a conventional roof antenna. Such a conventional roof antenna will be described with reference to reference numerals shown in FIG. 1.

FIG. 2(*a*) is a view illustrating the lower case 63 of the roof antenna 60 combined with the surface of the vehicle roof 50. The lower case 63 may be fastened to the vehicle roof 50 through mechanical connection parts 91, 92, 93, 95, 97 and 99 using bolts or nuts. The surface of the lower case 63 combined with the surface of the vehicle roof 50 may include first to fourth diaphragms 71, 73, 75 and 77 as watertight diaphragms (ribs) to prevent the introduction of water.

FIG. 2(*b*) is a cross-sectional view of the lower case 63. The cross-section of the first diaphragm 71 corresponds to a portion 81 and the cross-section of the second diaphragm 73 corresponds to a portion 83. Since vehicles have different R values (curvatures) of vehicle roof frames (as the R value of a vehicle roof frame increases, flatness of the vehicle roof frame increases), watertight diaphragms having different shapes according to vehicle types are developed. The reason for this is that, when the roof 50 and the lower case 63 are fastened to each other using nuts, diaphragms (ribs) may be pressed.

Further, other conventional problems will be described with reference to FIG. 3. As exemplarily shown in FIG. 3, it may be known from an enlarged view of a connection portion between an upper case 10 (65 of FIG. 1) and a lower case 63 of a roof antenna 60 that a diaphragm 11 of the upper case 10 may be coupled with a rubber member 23 of the lower case 63. If water is sprayed at a high pressure to such a coupling portion, a watertight function may fail. Therefore, development of an improved roof antenna is required.

SUMMARY

Accordingly, the present disclosure is directed to a roof antenna for vehicles and a watertight structure for a roof antenna for vehicles that substantially obviate one or more problems due to limitations and disadvantages of the related art.

An object of the present disclosure is to provide a roof antenna which may increase applicability of parts regardless of vehicle types and vehicle frames.

Another object of the present disclosure is to provide a roof antenna which may have excellent watertightness.

Additional advantages, objects, and features of the disclosure will be set forth in part in the description which follows and in part will become apparent to those having ordinary skill in the art upon examination of the following disclosure or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a roof antenna attached to a vehicle, in certain exemplary embodiments, includes an adhesive applied to a designated thickness, an upper case formed in a streamlined dome shape having an opened lower surface, and a lower case combined with the upper case, shielding the opened lower surface of the upper case and provided with an antenna module mounted on an upper surface of the lower case, wherein the lower case is attached to a roof of the vehicle, one surface of a pad formed of the adhesive is applied to a lower surface of the lower case, and another surface of the pad formed of the adhesive is attached to the roof.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further, non-limiting, understanding of the disclosure and are incorporated in and constitute a part of this application, illustrate embodiment(s) of the disclosure and together with the description serve to explain the principles of the disclosure. In the drawings.

DETAILED DESCRIPTION

Figure 1:
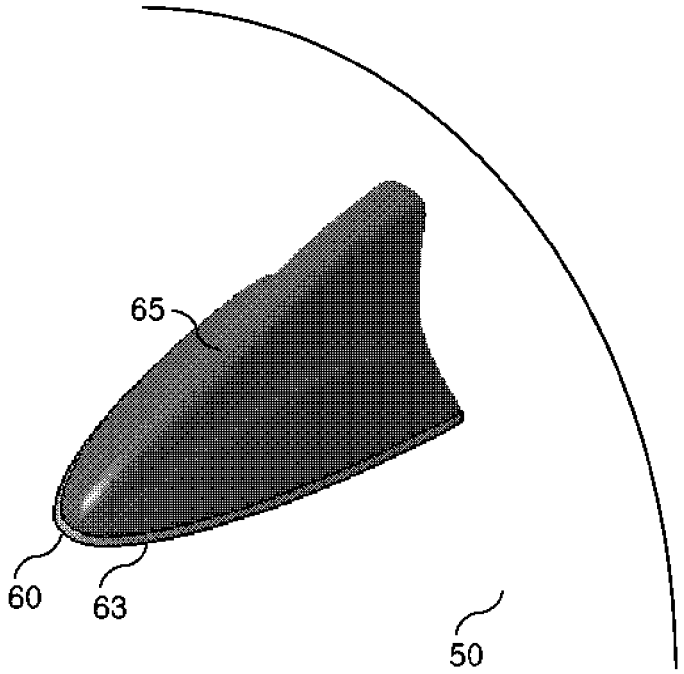
FIG. 1 is a view illustrating an exemplary roof antenna.

Reference will now be made in detail to embodiments of the present disclosure, examples of which are illustrated in the accompanying drawings. The suffixes "module" and "unit" used in the description below are given or used together only in consideration of ease in preparation of the specification and do not have distinctive meanings or functions.

In the following description of the embodiments, it will be understood that, when each element is referred to as being "on (above) or under (below)" or "in front of or at the rear of" another element, the two elements may directly contact or one or more other elements may be interposed between the elements.

Further, the terms "first", "second", "A", "B", "(a)", "(b)" etc., may be used to describe elements of the present disclosure. These terms are used only to distinguish the corresponding elements from other elements but do not limit the nature, order or sequence of the corresponding elements. In addition, it will be understood that, when one element is referred to as being "connected to", "combined with" or "coupled with" another element, it may be directly "connected to", "combined with" or "coupled with" the other element or intervening elements may also be present therebetween.

In the following description of the embodiments, it will be interpreted that the terms "including", "consisting of", "having" etc. may mean the presence of corresponding elements, unless stated otherwise, and do not exclude the presence of other elements. All terms including technical or scientific terms have the same meanings as generally understood by those skilled in the art, unless stated otherwise. Generally used terms, such as terms defined in dictionaries, should be interpreted as having meanings coinciding with contextual meanings in the related technology and are not interpreted as having ideal or excessively formal meanings, unless defined clearly in the present disclosure.

FIGS. 4*a* to 4*d* are views illustrating surfaces of lower cases of roof antennas combined with a roof of a vehicle frame in accordance with embodiments of the present disclosure. In the drawings, the same or similar elements are denoted by the same reference numerals even though they are depicted in different drawings.

Figure 4A:
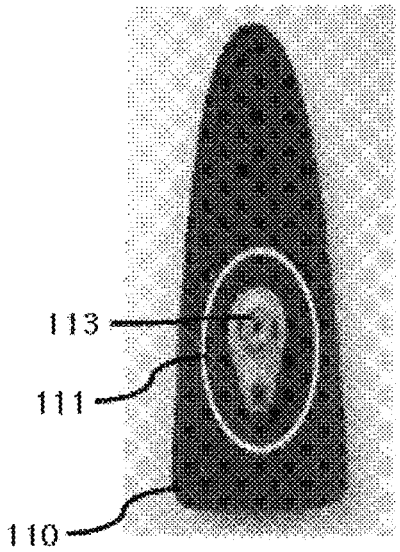
FIGS. 4*a* to 4*d* are views illustrating surfaces of lower cases of roof antennas combined with a roof of a vehicle frame in accordance with exemplary embodiments of the present disclosure.

As exemplarily shown in FIG. 4*a*, a roof antenna 60 includes an upper case and a lower case 110. The upper case may be formed in a streamlined dome shape, the lower surface of which is opened, and may be a cup-shaped hollow body. The roof antenna 60 is configured such that the lower part of the upper case is shielded by the lower case 110.

Figure 2A:
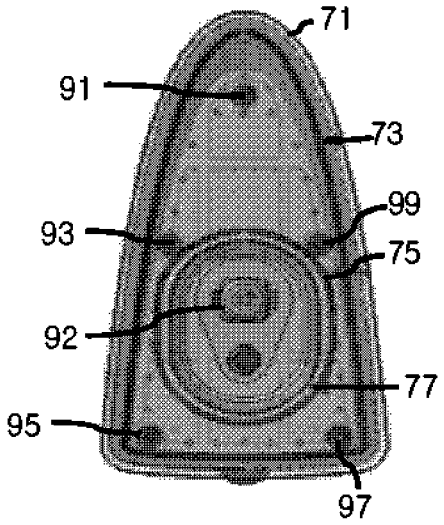
FIGS. 2*a* to 3 are views illustrating exemplary structures of conventional roof antennas.
Figure 2B:
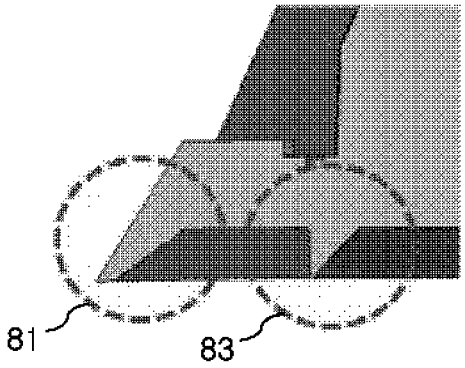

The lower case 110 may be fastened to a vehicle roof 50 through a fastening part 113 (with reference to 91, 93, 95, 97 and 99 of FIG. 2*a*) using bolts and nuts. Here, the lower case 110 is connected to the vehicle roof 50 through the first fastening part 113, while second to sixth fastening parts 91 to 99 may not be required. For example, a third diaphragm 75 (of FIG. 2*a*) or 111 (of FIG. 4*a*) may be removed and thus the manufacturing costs of a product may be lowered.

A plurality of diaphragms 71, 73, 75 and 77 (of FIG. 2*a*) may be removed from the lower case 110 contacting the vehicle roof 50, as needed. However, the first diaphragm 71 of FIG. 2*a* may be disposed so as to assure watertightness.

Figure 4B:
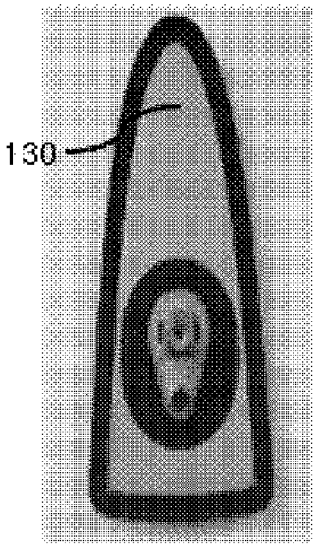

As exemplarily shown in FIG. 4*b*, an adhesive pad (a sealant pad) 130 may be disposed on a surface of a lower case 110 contacting the roof 50. The pad 130 may have strong adhesiveness and a designated thickness. Therefore, although R values of vehicle frames are different according to vehicle types and vehicle frames, the pad 130 having flexibility may adhere the lower surface of the lower case 110 to the roof 50. Although the pad 130 may be a pad formed of butyl, pads formed of various materials may be used as the pad as long as the pads may have a designated thickness and assure adhesiveness and flexibility.

The pad 130 may be protected by paper layers so as to protect adhesiveness of the pad 130 from external environments and, when the lower case 110 is combined with the roof, the paper layers may be removed. A tag 135 shown in FIG. 4*d* to judge whether or not the paper layers are removed may be connected to the pad 130 so that a worker may confirm whether or not the paper layers are removed. The paper layers may be formed of various materials which do not damage adhesiveness of the pad 130.

Figure 4C:
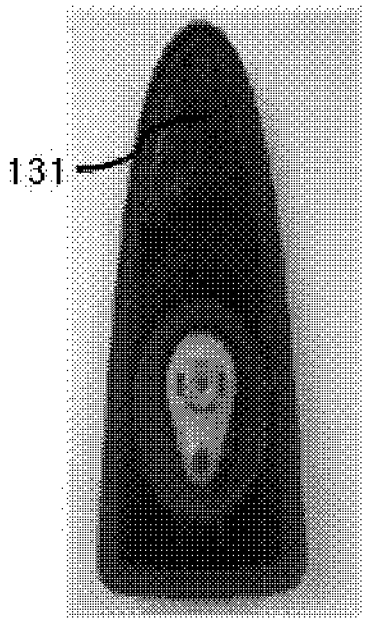
Figure 4D:
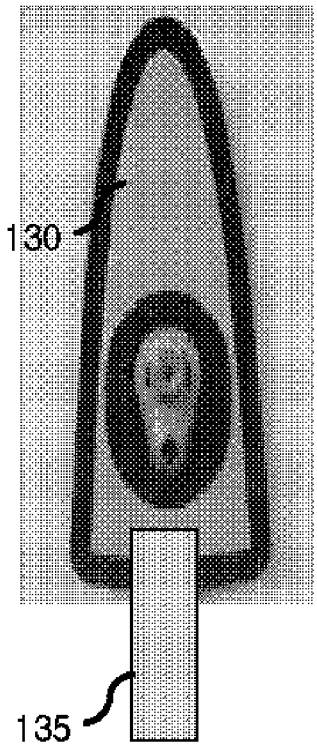

FIG. 4*c* illustrates a pad 131 from which the paper layers are removed. The pad 131 may be adhered to a vehicle frame and thus firmly fixed to the vehicle frame. Further, as described above, the pad 131 has a designated thickness and may thus be used regardless of an R value of vehicle roof 50. Therefore, a conventional inconvenience in that roof antennas having different shapes according to R values of vehicle frames need to be manufactured is solved. That is, if there is a large variation of vehicle frames, applicability is difficult. Therefore, the variety of R values of curved surfaces is absorbed, or accounted for, using the roof antenna of the present disclosure. Thus, greater applicability of parts is enabled.

Figure 5:
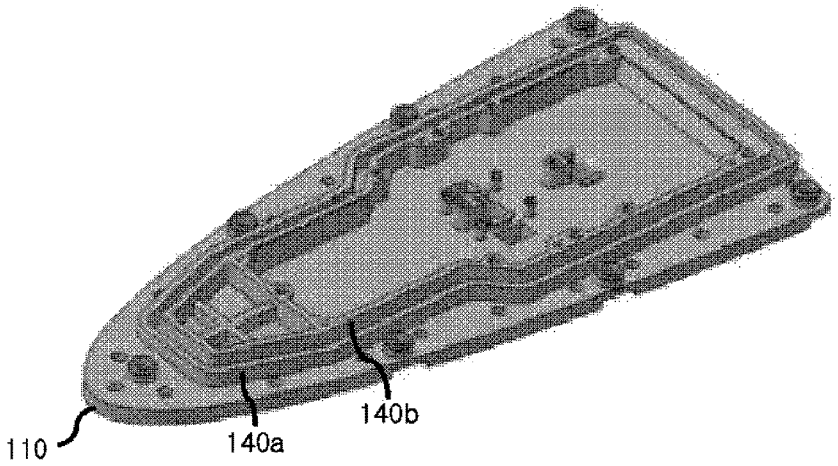
FIG. 5 is a perspective view illustrating a surface of a lower case contacting an upper case in accordance with exemplary embodiments of the present disclosure.

FIG. 5 is a perspective view illustrating a surface of a lower case contacting an upper case in accordance with exemplary embodiments of the present disclosure.

With reference to FIG. 5, a lower case 110 may include a first diaphragm 140*a* and a second diaphragm 140*b*. The first diaphragm 140*a* and the second diaphragm 140*b* serve to assure watertightness. However, the lower case 110 may include a larger/smaller number of diaphragms than the first diaphragm 140*a* and the second diaphragm 140*b*.

An antenna module may be mounted between the first diaphragm 140*a* and the second diaphragm 140*b*, thereby assuring watertightness.

Figure 3:
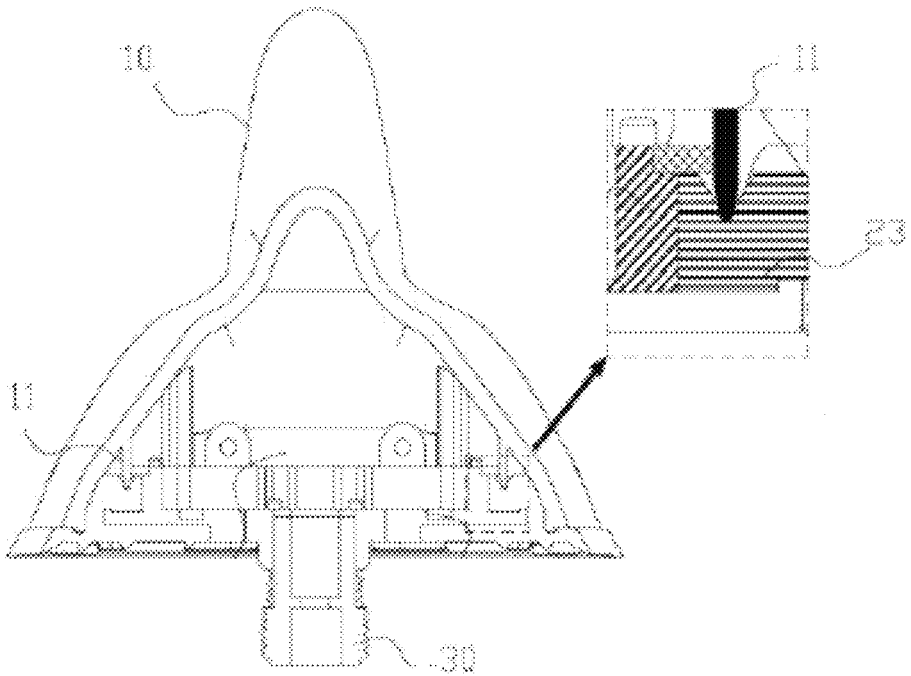
Figure 6:
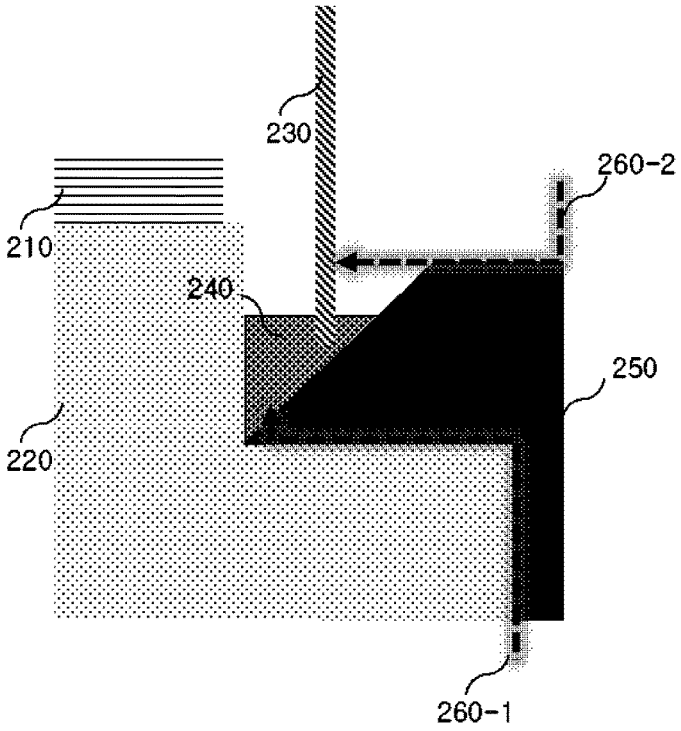
FIGS. 6 and 7 are views illustrating combination structures between an upper case and a lower case in accordance with exemplary embodiments of the present disclosure.
Figure 7:
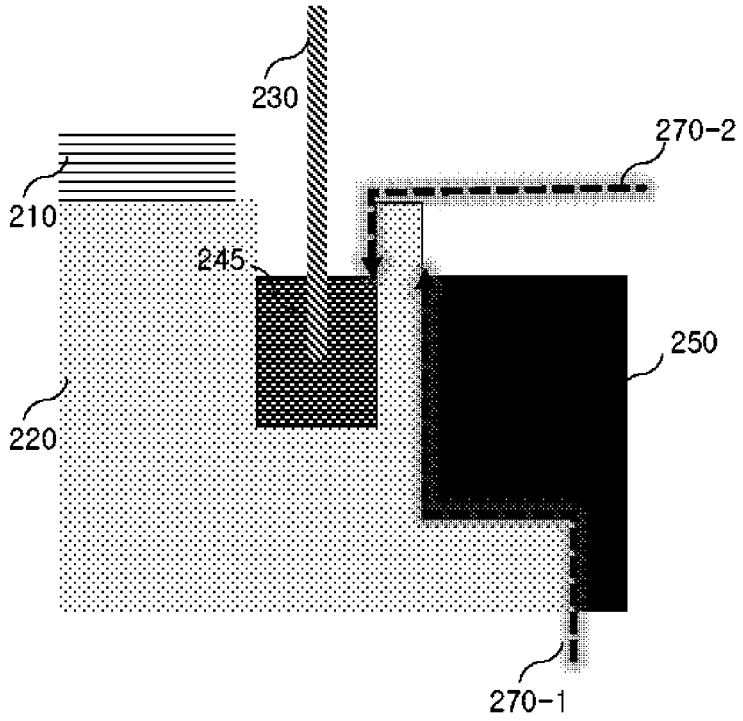

FIGS. 6 and 7 are views illustrating combination structures between an upper case and a lower case in accordance with exemplary embodiments of the present disclosure. These figures are compared with the enlarged view of FIG. 3.

FIG. 6 illustrates a state in which an upper case and a lower case 110 of a roof antenna 60 are combined.

A PCB 210 is a board on which a circuit of the roof antenna 60 is mounted. A base 220 is disposed under the PCB 210. The base 220 may employ a zinc base or an aluminum base but is not limited thereto.

Here, a rubber member 250 may be formed together with the base 220 through insert injection molding.

When a diaphragm 230 of the upper case is combined with the lower case 110, an adhesive (for example, formed of a sealant) may be applied to a combination part 240. Thereby, the upper case and the lower case 110 may be firmly combined. The roof antenna of the present disclosure exhibits excellent shielding effects and watertightness, as compared to a conventional method in which a diaphragm of an upper case is combined with a groove of a rubber member.

Further, the roof antenna of the present disclosure may effectively prevent moisture or foreign substances from being introduced into a first path 260-1 (270-1) or a second path 260-2 (270-2).

Moreover, the roof antenna of the present disclosure forms a sealant groove having an inclined plane structure which may be formed through insert injection molding, thus being capable of improving product manufacturability.

FIG. 7 illustrates another embodiment differing from the embodiment shown in FIG. 6. A groove 245 is formed on a base 220 and an adhesive is applied to the groove 245, thereby preventing the introduction of moisture and foreign substances in a third direction and a fourth direction.

In FIGS. 6 and 7, diaphragms of the base 220 (i.e., the first and second diaphragms 140*a* and 140*b* shown in FIG. 5) may assure excellent watertightness. In more detail, if a groove to which an adhesive is applied is disposed between the first diaphragm 140*a* and the second diaphragm 140*b*, excellent watertightness results. The groove may be formed through the protruding diaphragms 140*a* and 140*b* and may have a closed curve shape.

Figures 8A, 8B:
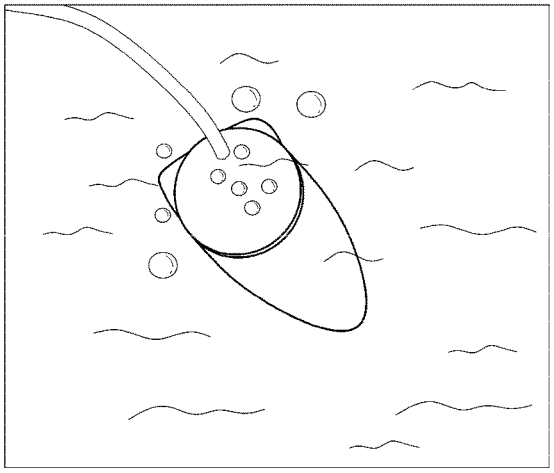
FIGS. 8*a* and 8*b* are a photograph and a table representing a result of an evaluation of a watertight properties of a roof antenna in accordance with exemplary embodiments of the present disclosure.

FIGS. 8*a* and 8*b* are a photograph and a table representing a result of an evaluation of watertightness of a roof antenna in accordance with exemplary embodiments of the present disclosure. Here, a jig test which is executed in a laboratory and a vehicle test may be simultaneously executed.

With reference to FIG. 8*a*, an experiment in which air is injected into a roof antenna 60 and then air is discharged from the roof antenna 60 underwater is executed.

As exemplarily shown in FIG. 8*b*, in the case of a conventional mass-produced roof antenna, air is discharged to the outside of the roof antenna at a pressure of 0.2 bar but, in the case of a roof antenna of the present disclosure, air is discharged to the outside of the roof antenna at a pressure of 2.6 bar. This indicates that the roof antenna of the present disclosure has watertightness of 13 times that of the conventional roof antenna.

Tested vehicles include a 'flat' vehicle having a large R value of a vehicle frame and a 'curved' vehicle having a small R value of a vehicle frame. Therefore, it may be known that the roof antenna of the present disclosure has excellent vehicle compatibility.

Figures 9A, 9B:
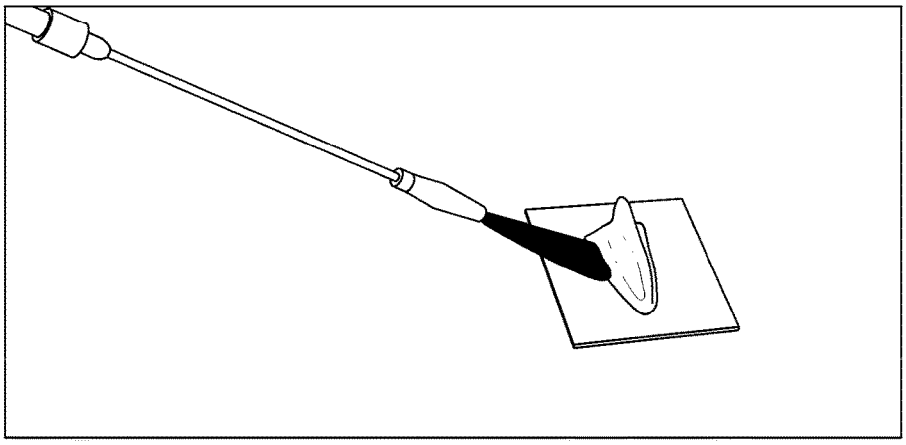
FIG. 9*a* is a photograph representing a method of testing applicability of a roof antenna in accordance with exemplary embodiments of the present disclosure.
FIG. 9*b* is a table representing a result of the test of FIG. 9*a*.

FIG. 9*a* is a photograph representing a method of testing applicability of a roof antenna in accordance with exemplary embodiments of the present disclosure and FIG. 9*b* is a table representing a result of the test of FIG. 9*a*.

With reference to FIG. 9*a*, a roof antenna 60 may be combined with another vehicle frame differing from a vehicle frame to which the present disclosure is applied and then water is sprayed onto the vehicle frame. Here, a distance between the roof antenna 60 and a water spray unit may be 10 cm and 20 cm.

As exemplarily shown in FIG. 9*b*, in the roof antenna 60 of the present disclosure, when water is sprayed onto the roof antenna 60 at a pressure of 180 bar from a distance of 10 cm and when water is sprayed onto the roof antenna 60 at a pressure of 180 bar from a distance of 20 cm, watertightness of the roof antenna 60 may be secured. A result of such a test overcomes drawbacks of a conventional roof antenna evaluated as "Not Good."

Figure 10A:
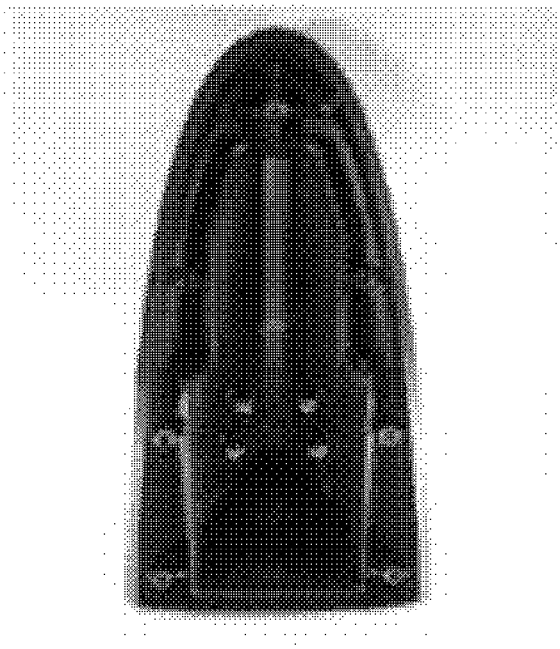
FIGS. 10*a* and 10*b* are views illustrating a roof antenna in accordance with exemplary embodiments of the present disclosure.
Figure 10B:
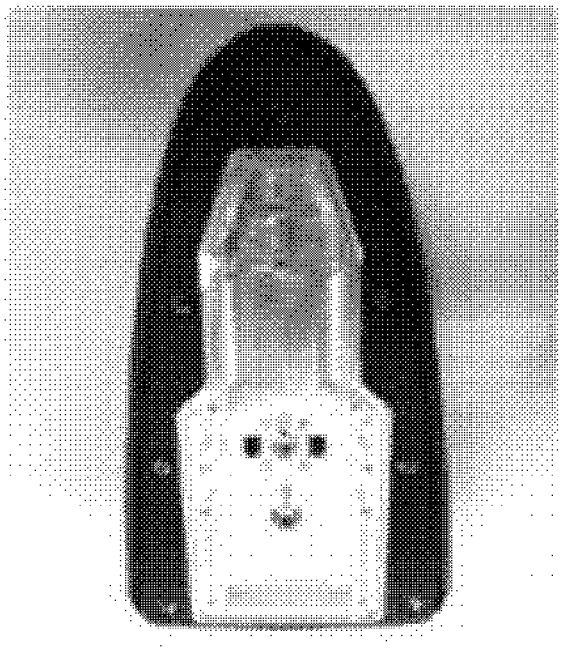

FIGS. 10*a* and 10*b* are views illustrating a roof antenna in accordance with exemplary embodiments of the present disclosure.

FIGS. 10*a* and 10*b* illustrate the above-described roof antenna 60. Such figures illustrate actual implementations of the roof antenna 60 in which the above-described watertight structure is reflected.

In accordance with the present disclosure, watertightness of the roof antenna 60 is secured, a circuit board within the roof antenna 60 is protected and product stability is improved and peeling off of the roof antenna 60 from a vehicle frame may be prevented.

As is apparent from the above description, a roof antenna for vehicles and a watertight structure thereof in accordance with various embodiments of the present disclosure has effects, as follows.

First, the roof antenna may assure applicability regardless of vehicle type and vehicle frame, thus having excellent product applicability and improving assembly efficiency.

Second, the roof antenna may prevent moisture and foreign substances from being introduced thereinto, thereby improving equipment and enhancing performance.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A watertight structure of a roof antenna attached to a vehicle, comprising:

an upper case having at least one diaphragm and an opened lower surface;

a lower case configured to be combined with the upper case and having a groove at a portion thereof connected to the at least one diaphragm;

a base disposed on an upper surface of the lower case and located under an antenna circuit board;

an elastic body integrally attached to the base and including an inclined plane in the groove between the elastic body and the base;

a first adhesive applied to a portion of the groove of the lower case;

a second adhesive applied to a portion of the inclined plane of the elastic body;

a sealant applied to a region where the lower case and the at least one diaphragm of the upper case are bonded; and an adhesive pad disposed between a lower surface of the lower case and a roof of the vehicle and having a prescribed thickness, wherein the adhesive pad includes a sealant pad or a butyl pad, wherein the elastic body is in contact with the upper surface and a side surface of the lower case, and wherein a height of the elastic body is lower than a height of the base entirely.

2. The watertight structure according to claim 1, wherein an introduction of moisture and foreign substances into the roof antenna is prevented.

3. The watertight structure according to claim 1, wherein the base includes zinc or aluminum.

4. The watertight structure according to claim 1, wherein the groove has a closed curve shape.

* * * * *